US011486666B2

(12) United States Patent
Head

(10) Patent No.: US 11,486,666 B2
(45) Date of Patent: Nov. 1, 2022

(54) FIREARM MAGAZINE LOADERS AND LOADER ASSEMBLIES

(71) Applicant: Vulcan Ballistic Products, LLC, Greenville, SC (US)

(72) Inventor: Thomas S. Head, Greenville, SC (US)

(73) Assignee: VULCAN BALLISTIC PRODUCTS, LLC, Greenville, SC (US)

( * ) Notice: Subject to any disclaimer, the term of this patent is extended or adjusted under 35 U.S.C. 154(b) by 107 days.

(21) Appl. No.: 17/039,728

(22) Filed: Sep. 30, 2020

(65) Prior Publication Data

US 2022/0099395 A1 Mar. 31, 2022

(51) Int. Cl.
*F41A 9/84* (2006.01)

(52) U.S. Cl.
CPC ..... *F41A 9/84* (2013.01)

(58) Field of Classification Search
CPC ..... F41A 9/83; F41A 9/84
See application file for complete search history.

(56) References Cited

U.S. PATENT DOCUMENTS 4,689,909 A * 9/1987 Howard ..... F41A 9/83 42/87
4,719,715 A * 1/1988 Howard ..... F41A 9/83 42/87
4,869,009 A * 9/1989 Bennett ..... F41A 9/84 42/87
4,888,902 A * 12/1989 Knowles ..... F41A 9/83 42/87
5,417,003 A 5/1995 Claveau
6,178,683 B1 * 1/2001 Williams ..... F41A 9/83 42/90
6,189,254 B1 2/2001 Steitz
6,219,953 B1 * 4/2001 Bentley ..... F41A 9/83 42/90
D477,047 S * 7/2003 Springer ..... D22/108
6,754,987 B1 * 6/2004 Cheng ..... F41A 9/83 42/87
7,503,138 B2 3/2009 Tal
7,637,048 B2 12/2009 Tal
8,650,792 B1 2/2014 Overmars
8,931,199 B1 1/2015 Cauley, Jr.
9,003,687 B2 4/2015 Cauley, Jr.
9,121,859 B2 9/2015 Zheng et al.
9,335,108 B2 5/2016 Cauley, Jr.
D770,588 S 11/2016 Cauley, Jr.
9,574,836 B1 2/2017 Cauley, Jr.
9,772,152 B1 * 9/2017 Niccum ..... F41A 9/83
9,964,373 B2 * 5/2018 Mills ..... F41A 9/83
1,017,017 A1 1/2019 Cottrell
(Continued)

OTHER PUBLICATIONS

AlekSystem LLC: "400 Cor-Bon Caliber Universal Gun Magazine Loader by Bullet Blaster"; Oct. 12, 2020; https://www.amazon.com/Cor-Bon-Caliber-Universal-Magazine-Blaster/dp/B08KX48QBN/ref=sr_1_1?dchild=1&keywords=400+cor-bon+caliber+universal+gun+magazine+loader+by+bullet+blaster&qid=1602510461&sr=8-1.

*Primary Examiner* — Joshua T Semick
(74) *Attorney, Agent, or Firm* — Dority & Manning, P.A.

(57) ABSTRACT

Loaders and loader assemblies are provided. A loader that facilitates loading a cartridge into a firearm magazine includes a press member that extends from a first end to a second end. The loader further includes a plunger member that extends generally perpendicularly from the press member to a free end. The free end sized to engage the cartridge when loading the firearm magazine.

9 Claims, 9 Drawing Sheets

(56) References Cited

U.S. PATENT DOCUMENTS

| | | | | |
|---|---|---|---|---|
| 10,274,275 | B1 * | 4/2019 | Terrell | F41A 9/83 |
| 2013/0061505 | A1 * | 3/2013 | Faifer | F41A 9/83<br>42/87 |

* cited by examiner

FIREARM MAGAZINE LOADERS AND LOADER ASSEMBLIES

FIELD

The present disclosure relates generally to loaders and loader assemblies. In particular, the present disclosure relates to loaders and loader assemblies that facilitate the loading of cartridges into a firearm magazine.

BACKGROUND

Many repeating firearms, such as pistols, submachine guns, assault rifles, and others, utilize magazines (often referred to as a clip) to store and feed cartridges (or bullets) into the firearm. A popular type of magazine in modern rifles and handguns is the box magazine, which stores cartridges in either a singular column or double column (also referred to as a zig-zag stack). Typically, box magazines are detachable and function to move the cartridges stored within the magazine into a position where the can be loaded into a barrel chamber by the action of the firearm. For example, box magazines are often slidably received within a slot in the firearm, usually below the action but occasionally to the side or on top. Typical box magazines are self-contained mechanisms capable of being loaded and unloaded while detached from the host firearm.

Generally, cartridges are loaded into the box magazine one at a time and gradually compress a spring. The spring produces a force that guides the cartridges towards an opening in the magazine, in order to be fed into the chamber of the firearm. The force supplied by the spring can make loading cartridges into magazine increasingly difficult, especially when the magazine is approaching it carrying capacity and the spring force is at a near maximum. For example, operators having weaker hands or arthritis may not be able to load a magazine whatsoever. As such, an apparatus for loading a firearm magazine is desired in the art. In particular, an apparatus that reduces the difficulty of loading a firearm magazine is desired in the art.

BRIEF DESCRIPTION

Aspects and advantages of the loaders and loader assemblies in accordance with the present disclosure will be set forth in part in the following description, or may be obvious from the description, or may be learned through practice of the technology.

In accordance with one embodiment, a loader that facilitates loading a cartridge into a firearm magazine is provided. The loader includes a press member that extends from a first end to a second end. The loader further includes a plunger member that extends generally perpendicularly from the press member to a free end. The free end sized to engage the cartridge when loading the firearm magazine.

In accordance with another embodiment, a loader assembly that facilitates loading a cartridge into a firearm magazine is provided. The loader assembly defines a longitudinal direction, a vertical direction, and a transverse direction. The loader assembly includes a loader movably coupled to a clamping assembly. The loader includes a press member that extends from a first end to a second end and a plunger member extending generally perpendicularly from the press member to a free end. The free end is sized to engage the cartridge when loading the firearm magazine. The clamping assembly is configured to clutch the firearm magazine during the loading of the cartridge into the firearm magazine.

The clamping assembly includes a grip plate that extends from a first end to a second end in the vertical direction. The clamping assembly further includes a guide frame that is coupled to the first end of the grip plate. The guide frame includes at least one guide member. The clamping assembly further includes a first side plate and a second side plate. The first side plate and the second side plate each include follower portions that slidably couple to the at least one guide member of the guide frame. The clamping assembly further includes a first connection plate that is disposed between the first side plate and the grip plate and is rotatably coupled to both the grip plate and the first side plate. The clamping assembly further includes a second connection plate that is disposed between the second side plate and the grip plate and is rotatably coupled to both the grip plate and the second side plate.

In accordance with yet another embodiment, a loader that facilitates loading a cartridge into a firearm magazine is provided. The loader includes a press member extending from a first end to a second end. The loader further includes a plunger member extending generally perpendicularly from the press member along a depression axis to a free end. The free end sized to engage the cartridge when loading the firearm magazine. The plunger member defines a first width at coupled end, a second width at the free end, and a thickness. The first width is larger than the second width. The first width, the second width, and the thickness of the plunger member are sized to allow the plunger member to move between the firearm magazine feed lips towards a back wall of the firearm magazine.

These and other features, aspects and advantages of the present loaders and loader assemblies will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present loaders and loader assemblies, including the best mode of making and using the present systems and methods, directed to one of ordinary skill in the art, is set forth in the specification, which makes reference to the appended figures, in which.

DETAILED DESCRIPTION

Figure 1:
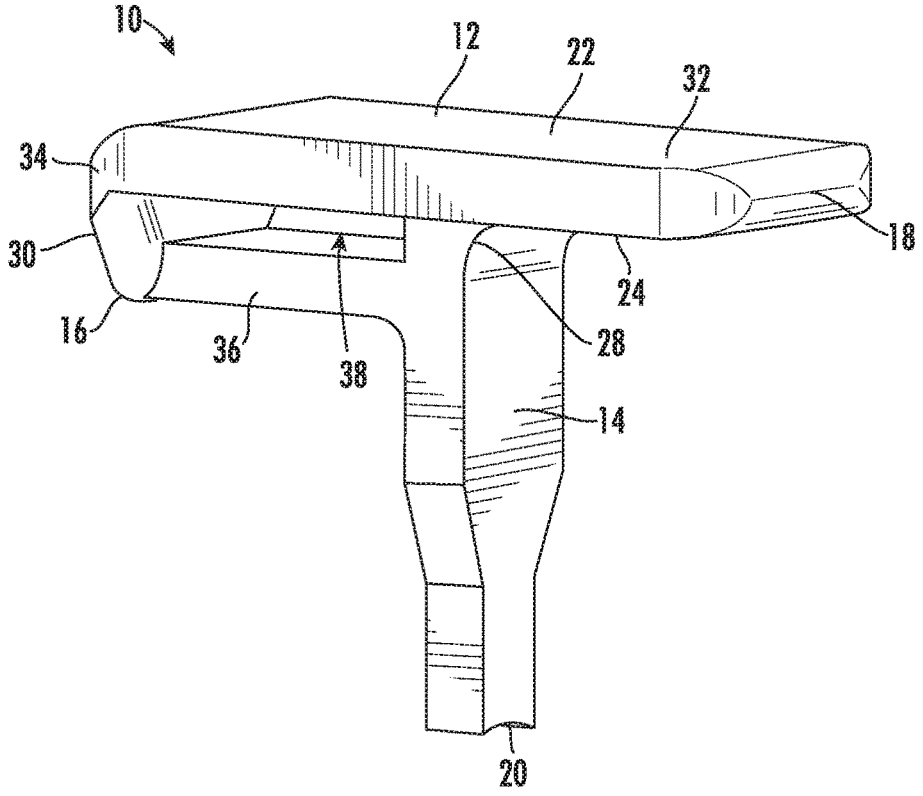
FIG. 1 illustrates a perspective view of a loader, in accordance with embodiments of the present disclosure.

Reference now will be made in detail to embodiments of the present loaders and loader assemblies, one or more examples of which are illustrated in the drawings. Each example is provided by way of explanation, rather than limitation of, the technology. In fact, it will be apparent to those skilled in the art that modifications and variations can be made in the present technology without departing from the scope or spirit of the claimed technology. For instance, features illustrated or described as part of one embodiment can be used with another embodiment to yield a still further embodiment. Thus, it is intended that the present disclosure covers such modifications and variations as come within the scope of the appended claims and their equivalents.

The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components.

As used herein, the terms. terms of approximation, such as "generally," "substantially," "approximately," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Figure 2:
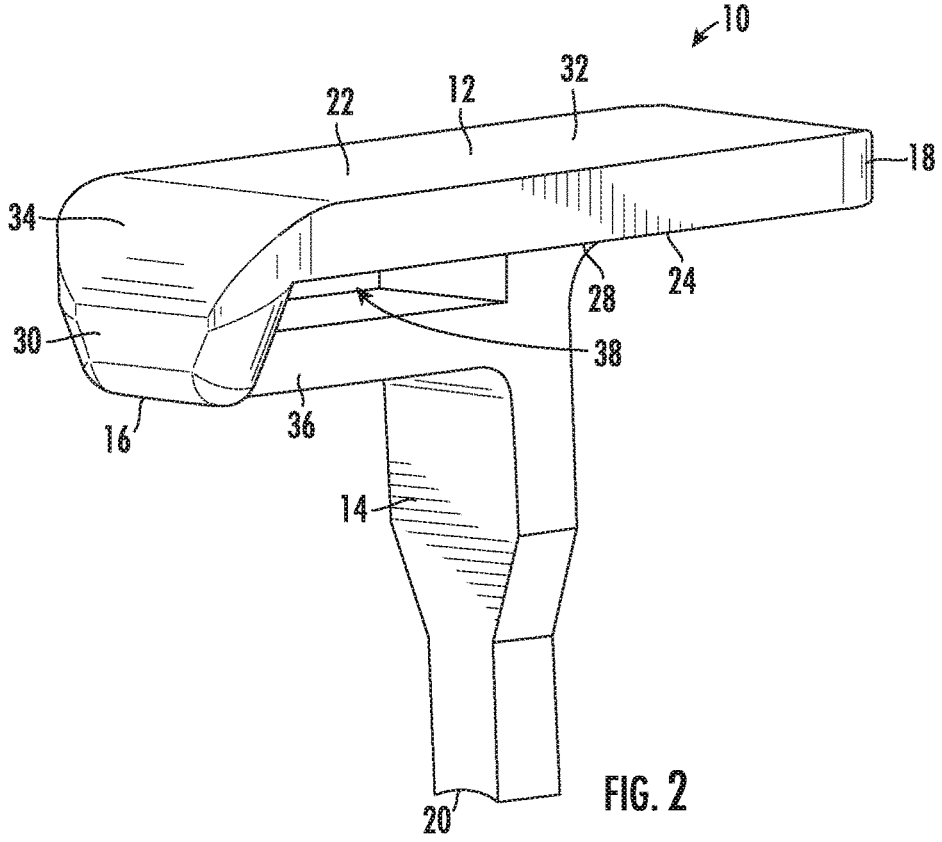
FIG. 2 illustrates a perspective view of a loader, in accordance with embodiments of the present disclosure.
Figure 3:
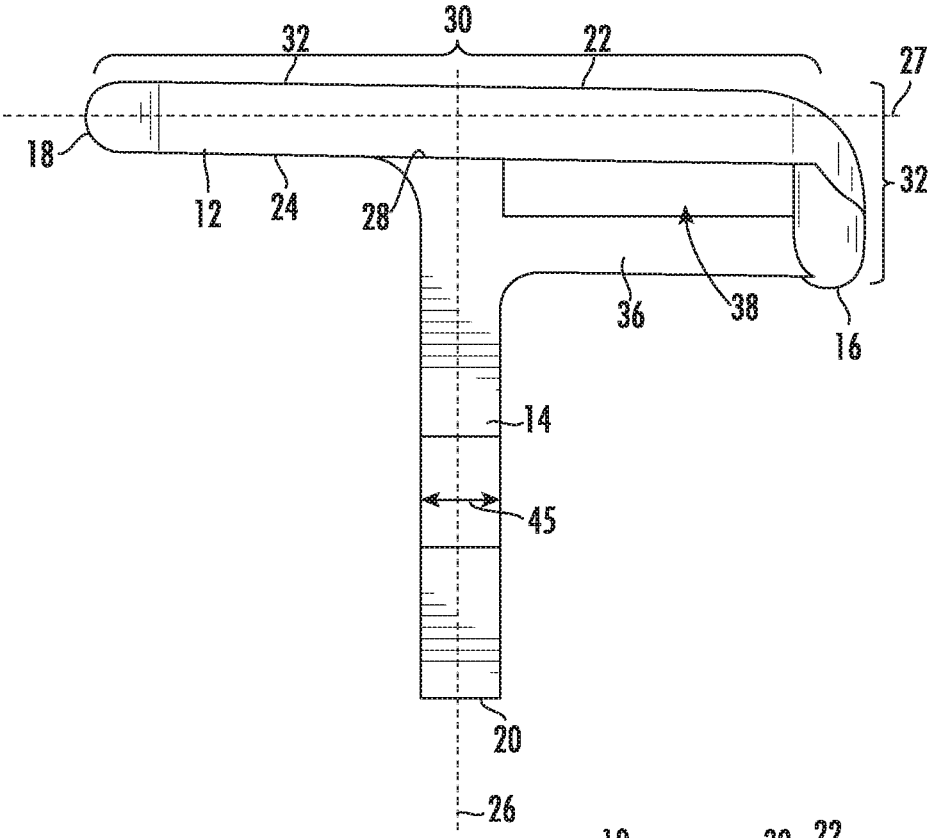
FIG. 3 illustrates a plan view of a loader, in accordance with embodiments of the present disclosure.
Figure 4:
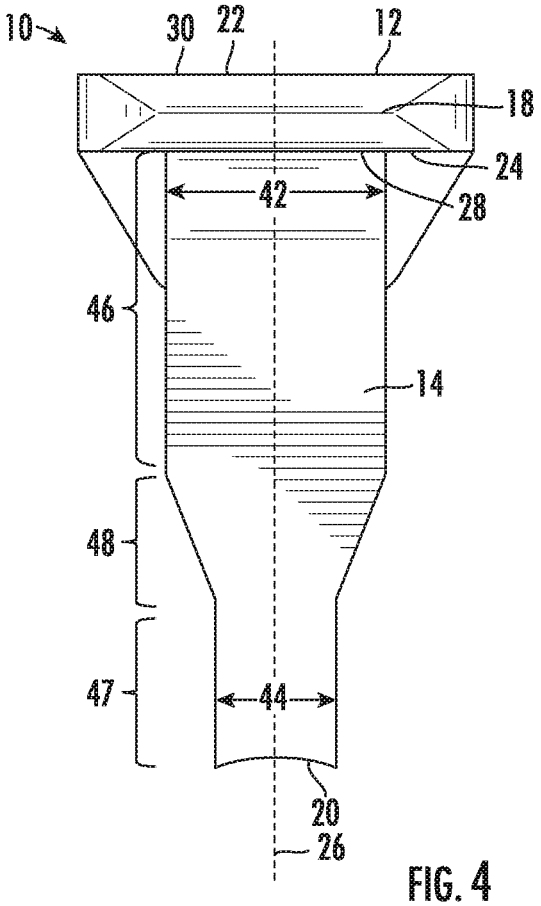
FIG. 4 illustrates a plan view of a loader, in accordance with embodiments of the present disclosure.
Figure 6:
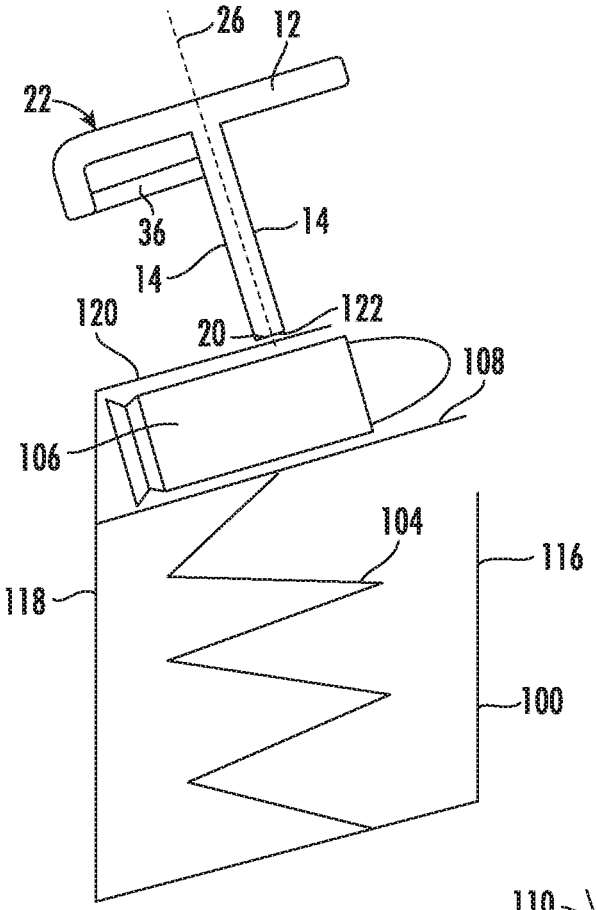
FIG. 6 illustrates a loader prior to the compression of an internal spring of a firearm magazine, in accordance with embodiments of the present disclosure.
Figure 7:
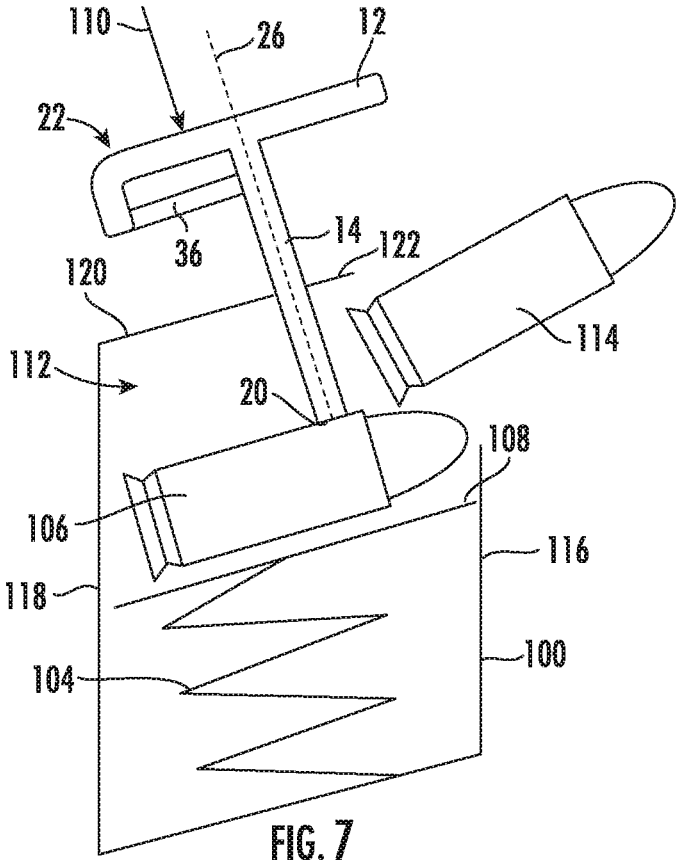
FIG. 7 illustrates a loader being used to compress an internal spring of a firearm magazine, in accordance with embodiments of the present disclosure.

Referring now to the drawings, FIG. 1 and FIG. 2 illustrate perspective views of an exemplary loader 10, and FIGS. 3 and 4 illustrate plan views of the loader 10, in accordance with embodiments of the present disclosure. The loader 10 shown and described herein may be utilized for facilitating the loading of cartridges 106 (or bullets) into a firearm magazine 100 (FIGS. 6 and 7). For example, the loader 10 may advantageously provide additional leverage for a user to compress an internal spring 104 of the firearm magazine 100, thereby allowing cartridges 106 to be loaded into the firearm magazine 100 with minimal effort by the user.

As shown in FIGS. 1-4 collectively, the loader 10 may include a press member or portion 12 and a plunger member or portion 14. The press member 12 may be generally sized to correspond with a user's thumb or finger, in order to receive an input force from the user's thumb or finger. In many embodiments, the press member 12 may extend from a first end 16 to a second end 18. As shown, the press member 12 may include an outer contact surface 22 spaced apart from, and oppositely disposed, an inner surface 24 with respect to the depression axis 26 (FIGS. 3 and 4). In exemplary embodiments, the outer contact surface 22 may be in contact with a user's finger and/or thumb during the operation of the loader 10. The outer contact surface 22 of the press member 12 may be generally smooth, such that there are no bumps or sharp edges that would cause discomfort or pain to a user when applying a force to the outer surface with their thumb or finger.

The plunger member 14 may extend generally perpendicularly from the press member 12 to a free end 20. For example, the plunger member 14 may extend from a coupled end 28 (e.g. an end that is coupled to the press member 12) to the free end 20. The free end 20 may be sized to engage a cartridge (or bullet) when loading the firearm magazine 100.

As shown in FIGS. 3 and 4, loader 10 may define a lateral axis 27 and a depression axis 26. The lateral axis 27 may be perpendicular to the depression axis 26. In many embodiments, the plunger member 14 may extend along the depression axis 26. In various embodiments, at least a portion of the pressure member 12 may extend along the lateral axis 27. For example, the press member 12 may include a lateral portion 30 that extends along the lateral axis 27 and a depression portion 32 that extends generally parallel to the depression axis 32. For example, the depression portion 32 may extend from the first end 16 of the press member 12 to a corner 34. The lateral portion 30 may extend from the corner 34 to the second end 18 of the press member 12. As shown in FIG. 3, the press member 12 may transition from the depression portion 32 to the lateral portion 30 at the corner 34. In various embodiments, the corner 34 may advantageously provide rounded transition between the depression portion 32 and the lateral portion 30, which may advantageously provide additional support for one or more joints of the user's finger and/or thumb when applying a force to the outer contact surface 22.

In particular embodiments, a cross bar 36 may extend between depression portion 32 of the press member 12 and the plunger member 14, such that the cross bar 36 is coupled to both the press member 12 and the plunger member 14. More specifically, the cross bar 36 may extend from the first end 16 of the press member 12 to the plunger member 14. In many embodiments, the cross bar 36 may be generally parallel to the lateral portion 30 of the press member 12. In other embodiments (not shown), the cross bar 36 may not be parallel to the lateral portion 30 of the press member 12. In many embodiments, the cross bar 36 may advantageously provide additional structural integrity to the loader 10, such that the press member 12 does not bend or flex when a user applies a force to the outer contact surface 22. In exemplary embodiments, the cross bar 36 may be spaced apart from the lateral portion 30 of the press member 12, such that an opening 38 is defined collectively between the press member 12, the plunger member 14, and the cross bar 36.

In exemplary embodiments, the plunger member 14 defines a first width 42 at the coupled end 28, a second width 44 at the free end 20, and a thickness 45. The first width 42 may be larger than the second width 44, such that the plunger member 14 converges in width along the depression axis 26 from the coupled end 28 to the free end 20. For example, as shown in FIG. 4, the plunger member 14 may taper from the first width 42 to the second width 44, which advantageously allows the plunger 14 to fit into any size firearm magazine (e.g. a pistol magazine, submachine gun magazine, assault rifle magazine, or others). For example, the taper from the larger first width 42 at the coupled end to the smaller second width 44 at the free end allows the plunger to be used with a large range of caliber cartridges 200. As is generally understood, the cartridge 106, 114 when initially loaded includes a bullet and a propellant therein. It should be understood that the present disclosure is not limited to any particular caliber cartridge, and rather that cartridges having any suitable caliber, i.e. .22, .38, .45, etc. may be utilized in accordance with the present disclosure.

In various embodiments, the first width 42 may be between about 0.374 inches and about 0.306 inches. In other embodiments, the first width 42 may be between about 0.36 inches and about 0.32 inches. In particular embodiments, the first width 42 may be between about 0.35 inches and about 0.33 inches.

In multiple embodiments, the second width 44 may be between about 0.187 inches and about 0.153 inches. In other embodiments, the second width 44 may be between about 0.182 inches and about 0.158 inches. In particular embodiments, the second width may be between about 0.177 inches and about 0.163 inches. In specific embodiments, the second width may be between about 0.172 inches and about 0.168 inches. The second width 44 being smaller than the first width 42 advantageously allows the plunger member 14 to fit into a large range of firearm magazines, such as .22, .38, .45, or other caliber magazines.

In many embodiments, the thickness 45 may be smaller than the widths 42, 44. For example, in some embodiments, the thickness 45 of the plunger member 14 may be between about 0.138 inches and about 0.113 inches. In other embodiments, the thickness 45 of the plunger member 14 may be between about 0.132 inches and about 0.118 inches. In particular embodiments, thickness 45 of the plunger member 14 may be between about 0.130 inches and about 0.120 inches As shown in FIGS. 1 and 2, the plunger member 14 may be a generally plate shaped member, such that the length (measured along the depression axis) and the width are generally larger than the thickness. This advantageously allows the plunger member to compress an internal spring of a firearm magazine without creating too large of a blockage that could prevent a cartridge from sliding into the magazine.

In many embodiments, wherein the second end 18 of the press member 12 may be sized to allow stripping (or removing) of cartridges 106, 114 from a loaded firearm magazine 100. For example, the second end 18 may be used to push a loaded cartridge out of a firearm magazine, such that the second end contacts the cartridge and provides additional leverage making the removal of the cartridge easy for the user. Similarly, the side walls 208, 210 of the loader assembly 200 discussed below may also be used for stripping loaded cartridges 106, 114 from a loaded firearm magazine.

As shown in FIGS. 1-4, the plunger member 14 include a first width portion 46, a second width portion 47, and a tapering portion 48 disposed between the first width portion 46 and the second width portion 47. The first width portion 46 may extend from the inner surface 24 of the press member 12 to the tapering portion 48. The first width portion 46 may define the first width 42 along its length, which is measured along the depression axis 26 from the inner surface 24 of the press member 12 to the tapering portion 48. The tapering portion 48 may extend along the depression axis 26 from the first width 46 portion to the second width portion 46. The tapering portion 48 may continuously taper from the first width 42 to the second width 47 along the depression axis 26. The second width 42 portion may extend from the tapering portion 48 to the free end 20. The second width 42 portion may define the second width 44 along its length, which is measured along the depression axis 26 from tapering portion 48 to the free end 20. The tapering of the plunger member 14 advantageously allows the loader 10 to be used on a large range of caliber firearm magazines, such as .22, .38, .45, or other calibers.

As shown best in FIG. 4, the free end 20 of the plunger member may be generally arcuate or curved to correspond to the curvature of a cartridge, in order to prevent a cartridge from sliding or moving when being loaded into a firearm magazine 100. For example, the free end 20 may curve about the lateral axis 27, such that it corresponds with an exterior surface of a cartridge 106, 114. The curvature may be defined in the free end 20 such that it is capable of interfacing with any caliber of cartridge, such as .22, .38, .45, or other calibers.

Figure 5:
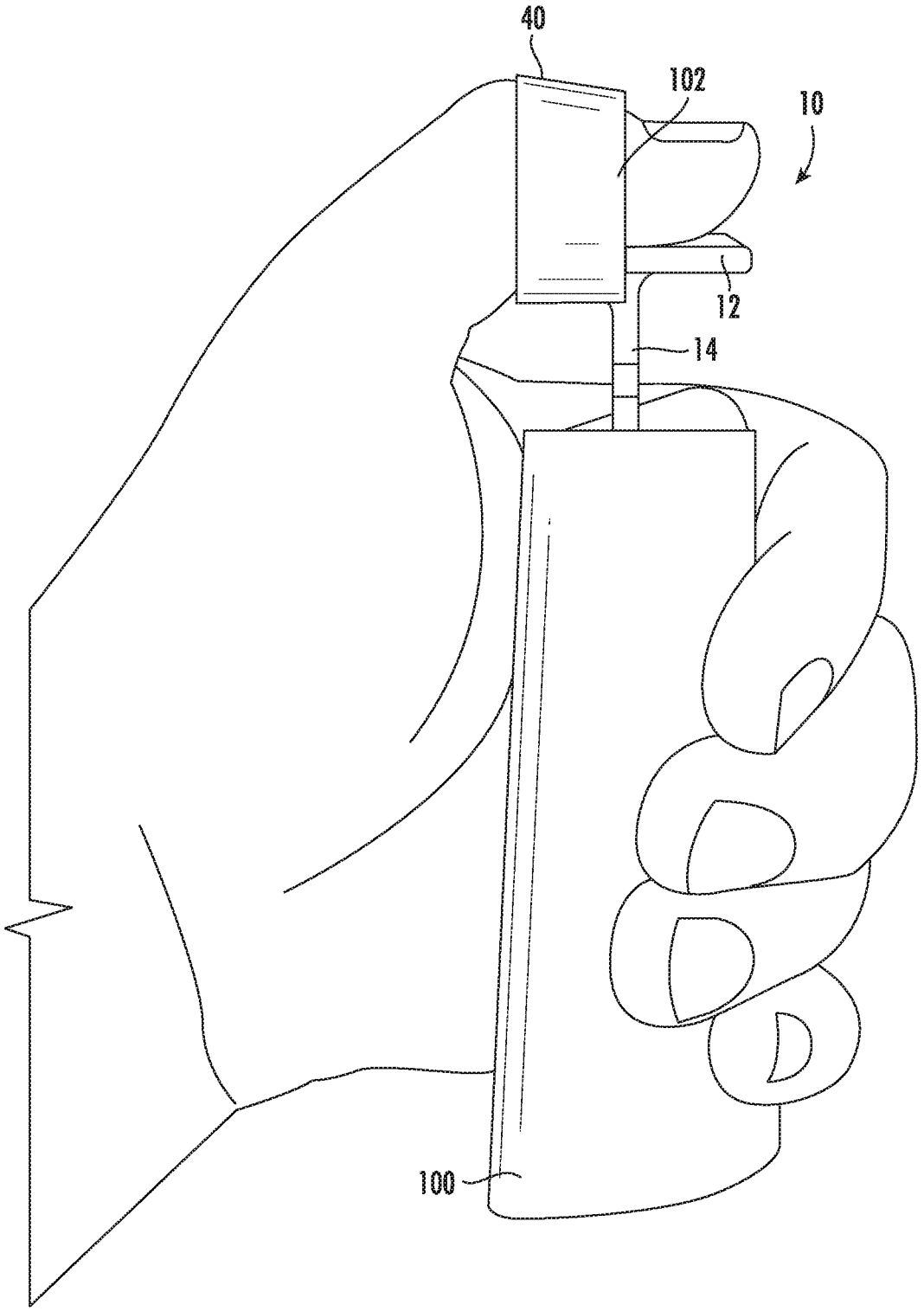
FIG. 5 illustrates a loader attached to a user's hand, in accordance with embodiments of the present disclosure.

FIG. 5 illustrates a loader 10 attached to a user's hand. The loader 10 is being utilized to compress an internal spring 104 of a firearm magazine 100. As shown, in some embodiments the loader 10 may be attached to a user's thumb 102 via a strap fastener 40. In other embodiments (not shown), the loader 10 may be attached, via the strap fastener 40, to one of a user's fingers. In exemplary embodiments, the strap fastener 40 may extend through the opening 38 of the loader 10, in order to couple the press member 12 of the loader 10 to one of a user's finger or a user's thumb. In particular embodiments, the strap fastener 40 may be in the form of a hook and loop fastener (such as Velcro), an elastic band, or other suitable strap fastener.

FIGS. 6 and 7 illustrate a loader 10 being utilized to compress an internal spring 104 of a firearm magazine 100. As shown, the firearm magazine 100 may have one of the external walls removed, in order to depict how the loader 10 interacts with the internals of the firearm magazine 100. Specifically, FIG. 6 illustrates the plunger member 14 of the loader 10 in contact with a first cartridge 106 that has already been loaded into the firearm magazine 100. However, the plunger 14 may also contact the feed surface 108 of the firearm magazine 100 if no cartridges have yet to be loaded into firearm magazine. FIG. 6 illustrates a force 110 being applied to the outer contact surface 22 of the press member 12 (which may be supplied by one of a user's finger or thumb), thereby driving the plunger member 14 onto the exterior surface of the first cartridge 106 and compressing the internal spring 104 of the firearm magazine 100. In this way, the force 110 is transferred from the user's finger or thumb by the plunger member 14 to the internal spring 104 of the firearm magazine 100. As shown in FIG. 6, once the internal spring 104 is compressed by the loader 10, an opening 112 is defined within the firearm magazine 100, that allows a second cartridge 114 to be loaded into the firearm magazine 100 easily. The above described process may be repeated until the firearm magazine 100 is fully loaded (or at capacity) with cartridges.

Figure 8:
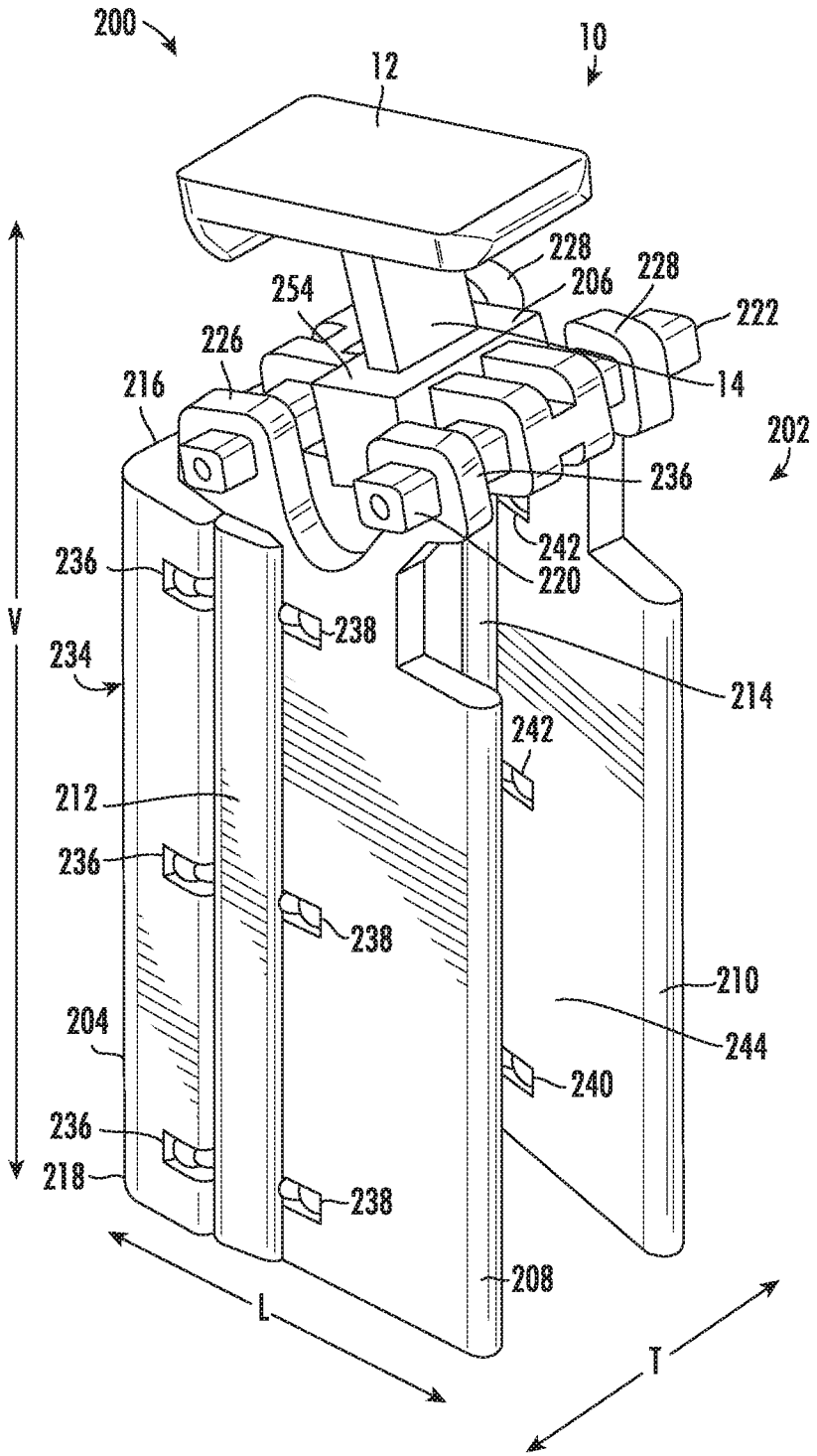
FIG. 8 illustrates a perspective view of a loader assembly, in accordance with embodiments of the present disclosure.
Figure 9:
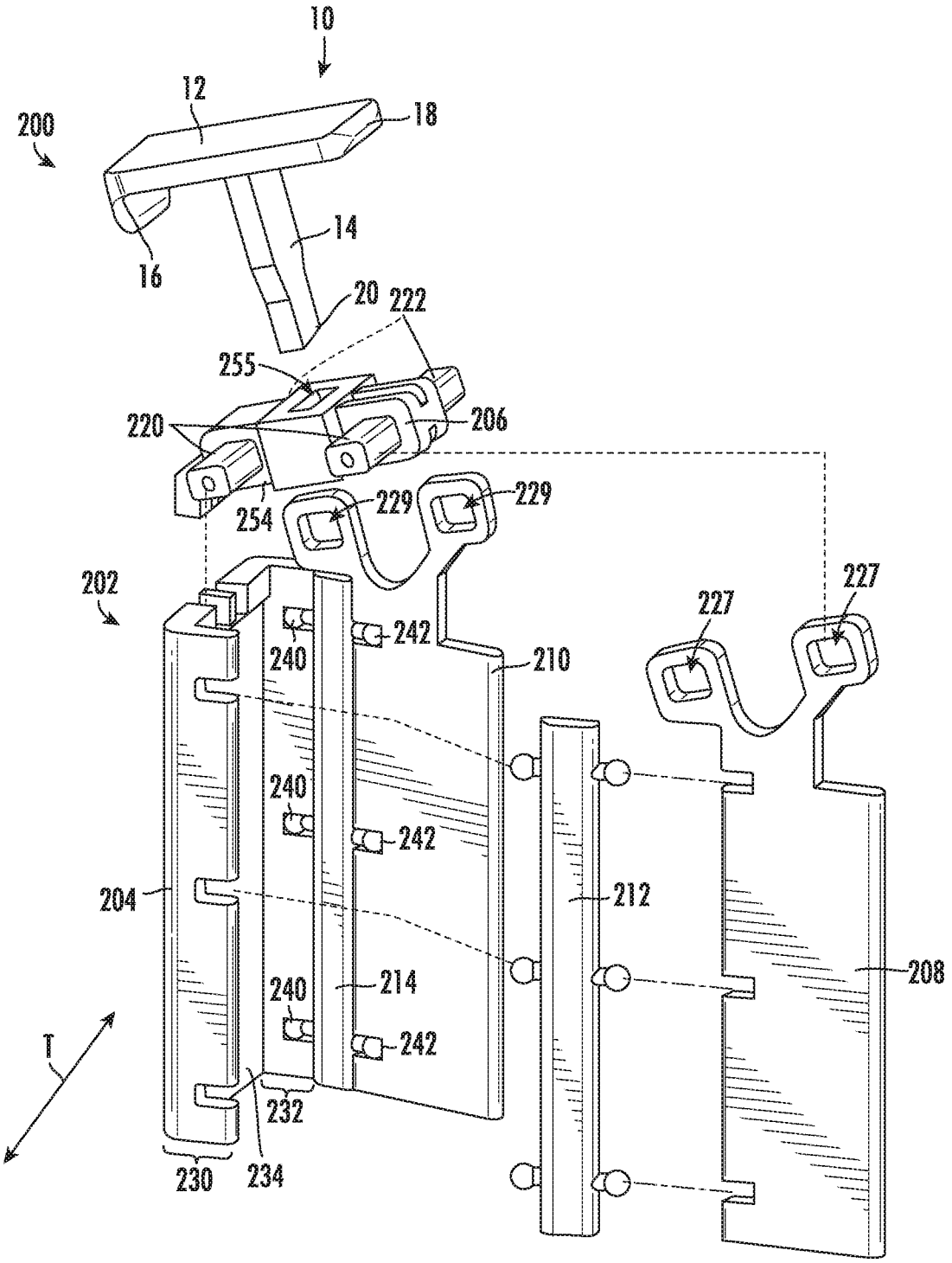
FIG. 9 illustrates a perspective view of a loader assembly, in which certain features have been exploded away, in accordance with embodiments of the present disclosure.
Figure 10:
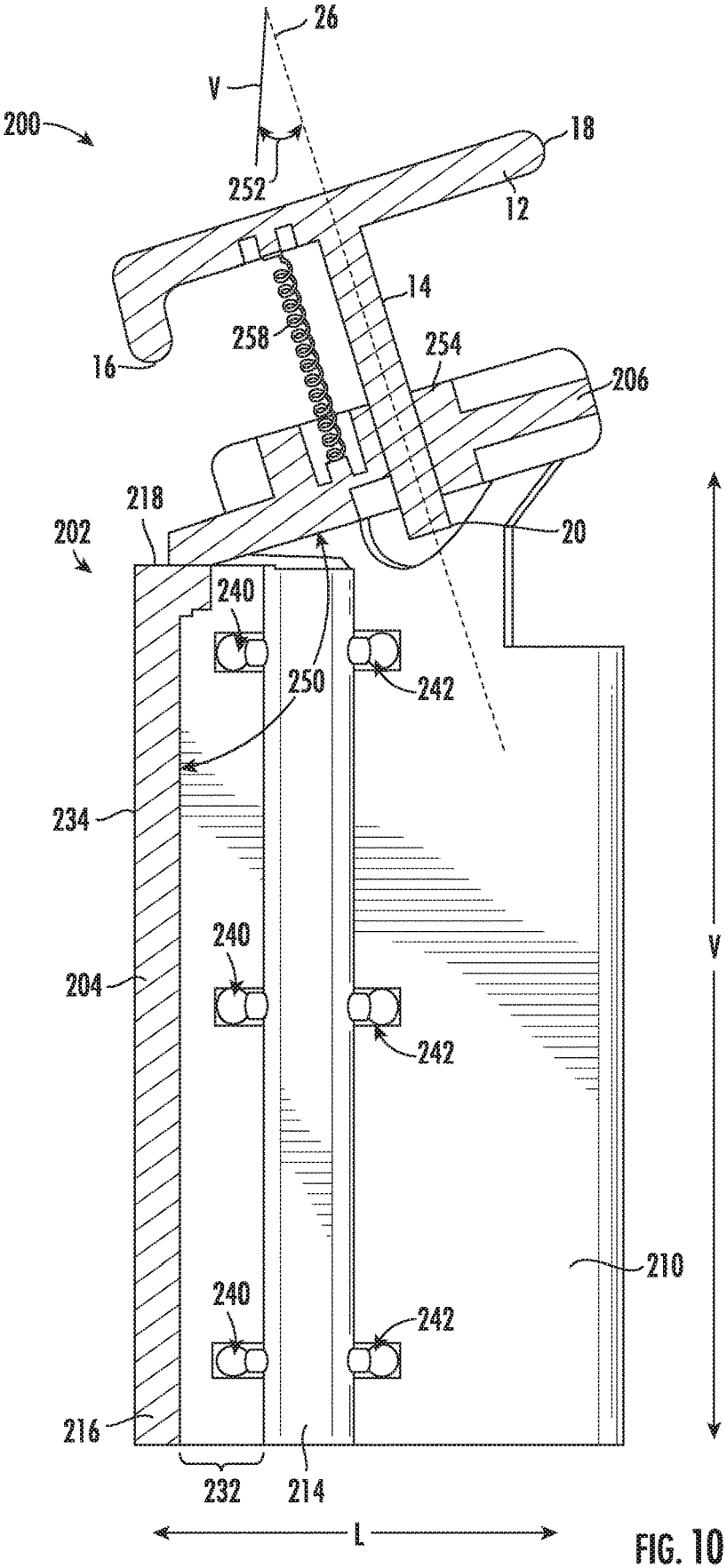
FIG. 10 illustrates a cross sectional view of the loader assembly, in accordance with embodiments of the present disclosure.

FIGS. 8-10 illustrate a loader assembly 200 that facilitates the loading of a cartridge into a firearm magazine. As shown, the loader assembly 200 defines a longitudinal direction L, a vertical direction V, and a transverse direction T, each of which is mutually perpendicular, such that an orthogonal coordinate system is generally defined. Specifically, FIG. 8 illustrates a perspective view of the loader assembly 200, FIG. 9 illustrates a perspective view of the loader assembly 200 in which certain components are exploded away, and FIG. 10 illustrates a cross-sectional view of the loader assembly 200 from along the transverse direction T, in accordance with embodiments of the present disclosure.

As shown in FIGS. 8-10 collectively, the loader assembly 200 may include a loader 10 movably coupled to a clamping assembly 202. As discussed above in detail, the loader 10 may include a press member 12 that extends from a first end to a second end and a plunger member 14 that extends perpendicularly from the press member to a free end. The clamping assembly 202 may include side walls that move in the transverse direction T, in order to clutch the firearm magazine during the loading of a cartridge into the firearm magazine 100. In many embodiments, the clamping assembly 202 may include a grip plate 204, a guide frame 206, a first side plate 208, a second side plate 210, a first connection plate 212, and a second connection plate 214.

In many embodiments, the grip plate 204 may extend in the vertical direction V from a first end 216 to a second end 218. The guide frame 206 may couple to the first end 216 of the grip plate 204. For example, the guide frame 206 may be fixedly coupled to the grip plate 204 at an angle, such that the guide frame 206 maintains its desired angle and does not rotate relative to the grip plate 204. In many embodiments, the guide frame 206 may include at least one guide member 222 that provides a rail for the side plates 208, 210 to slidably couple thereto, in order to facilitate movement in the transverse direction T and clamp the firearm magazine. For example, in exemplary embodiments, the guide frame 206 may include a first pair of guide members 220 and a second pair guide member 222.

In various embodiments, the pairs of guide members 220, 222 may extend in the transverse direction T and may function to provide a guiding surface for the side plates 208, 210, which are slidably coupled thereto. For example, the first side plate 208 and the second side plate 210 may each include a follower portion 226, 228. The follower portions 226, 228 of the side plates 208, 210 may each extend in the vertical direction V beyond the first end 216 of the grip plate 204 and slidably (or movably) couple to one of the pair of guide members 220, 222.

In many embodiments, the first pair of guide members 220 may extend through openings 227 defined within the first follower portion 226 of the first side plate 208, thereby slidably coupling the guide frame 206 to the first side plate 208. In this way, the first side plate 208 may be restricted to movement in the transverse direction T by the first pair of guide members 220, thereby advantageously allowing the first side plate 208 to maintain a desired angle when clutching the firearm magazine during the loading procedure. Similarly, the second pair of guide members 222 may extend through openings 229 defined within the second follower portion 228 of the second side plate 210, thereby slidably coupling the guide frame 206 to the second side plate 210. In this way, the second side plate 210 may be restricted to movement in the transverse direction T by the guide members 222, thereby advantageously allowing the second side plate 210 to maintain a desired angle when clutching the firearm magazine during the loading procedure.

Although the embodiments shown in FIGS. 8-10 illustrate the guide frame 206 as having a pair of guide members 220, 222 disposed on either side of the guide frame and slidably coupled to the follower portions 226, 228, other embodiments may include a singular guide member and corresponding follower portion on the side plates.

In many embodiments, as shown best in FIG. 9, the grip plate 204 may include a first side portion 230, a second side portion 232 spaced apart from the first side portion 230 in the transverse direction T, and an end portion 234. In many embodiments, the first side portion 230 and the second side portion 232 may each extend from the end portion 234 in the longitudinal direction L. The end portion may extend between the first side portion and the second side portion in the transverse direction T. In some embodiments, the first side portion 230 and the second side portion 232 may each extend generally perpendicularly from the end portion 234 of the grip plate 204.

As shown in FIGS. 8-10, the clamping assembly 202 may further include a first connection plate 212 and a second connection plate 214. The first connection plate 212 may be disposed between the grip plate 204 and the first side plate 208, such as between the first side portion 230 of the grip plate 204 and the first side plate 208. Similarly, the second connection plate 214 may be disposed between the grip plate 204 and the second side plate 210, such as between the second side portion 232 of the grip plate 204 and the second side plate 210.

In many embodiments, the first connection plate 212 may be rotatably coupled to both the grip plate 204 and the first side plate 208. For example, the first connection plate 214 may be connected to the grip plate 204 via a first plurality of ball socket joints 236 and connected to the first side plate 208 via a second plurality of ball socket joints 238. Similarly, the second connection plate 214 may be connected to the grip plate 204 via a third plurality of ball socket joints 240 and connected to the second side plate 210 via a fourth plurality of ball socket joints 242. The plurality of ball socket joints 236, 238, 240, 242 may advantageously allow the side plates 208, 210 to move in the transverse direction, along the pairs of guide members 220, 222 of the guide frame 206, such that the clamping assembly 202 may adjust the size of a primary opening 244 defined between the side plates 208, 210. In this way, the clamping assembly 202 may adjust to the size of various types of firearm magazines (such as pistol magazines, assault rifle magazines, submachine gun magazines, or others) and/or calibers of firearm magazines (such as .22, .38, .45, etc.). For example, the side plates 208, 210 may move in the transverse direction to clutch (or retain) any type or caliber firearm magazine.

Although the ball socket joints 236, 238, 240, 242 depicted in FIGS. 8-10 show sockets or concave openings disposed on the side portions 230, 232 of the grip plate 204 and on the side plates 208, 210 and balls disposed on the connection plates 212, 214, it is envisioned to be within the scope of the present disclosure that one or more of the balls may be disposed on the grip plate 204 and/or side plates 208, 210, and the corresponding socket(s) be disposed on the connection plates 212, 214.

As shown best in FIG. 10, the guide frame 206 may form an angle 250 with the end portion 234 of the grip plate 204 that is between about 97° and about 117°. In other embodiments, the guide frame 206 may form an angle 250 with the end portion 234 of the grip plate 204 that is between about 100° and about 115°. In various embodiments, the guide frame 206 may form an angle 250 with the end portion 234 of the grip plate 204 that is between about 102° and about 110°. In particular embodiments, the guide frame 206 may form an angle 250 with the end portion 234 of the grip plate 204 that is between about 105° and about 109°. The angle 250 advantageously allows the loader 10 to be inserted into the firearm magazine at a desired angle. For example, as shown in FIGS. 11 and 12, when a firearm magazine 100 is backed against the end portion 234 of the grip plate, the opening of the firearm magazine 100 may align with the plunger member 14 of the loader 10, which is set by the angle 250.

For example, in many embodiments, it may be desirable for the depression axis 26 to form an angle 252 with the vertical direction V, in order to provide additional leverage when compressing the internal spring of the firearm magazine 100. In many embodiments, the angle 252 defined between the depression axis 26 and the vertical direction V may be between about 5° and about 30°. In other embodiments, the angle 252 defined between the depression axis 26 and the vertical direction V may be between about 10° and about 25°. In various embodiments, the angle 252 defined between the depression axis 26 and the vertical direction V may be between about 15° and about 20°.

As shown in FIG. 10, the guide frame 204 of the loader assembly may include a central portion 254 that defines an opening 255. In exemplary embodiments, the plunger member 14 of the loader may extend through the opening 255 of the central portion 254 of the guide frame 206 and may be movable (along the depression axis 26) within the opening 255. For example, the plunger member 14 of the loader 10 may be restricted to movement along the depression axis 26 by the central portion 254 of the guide frame 206.

Figure 11:
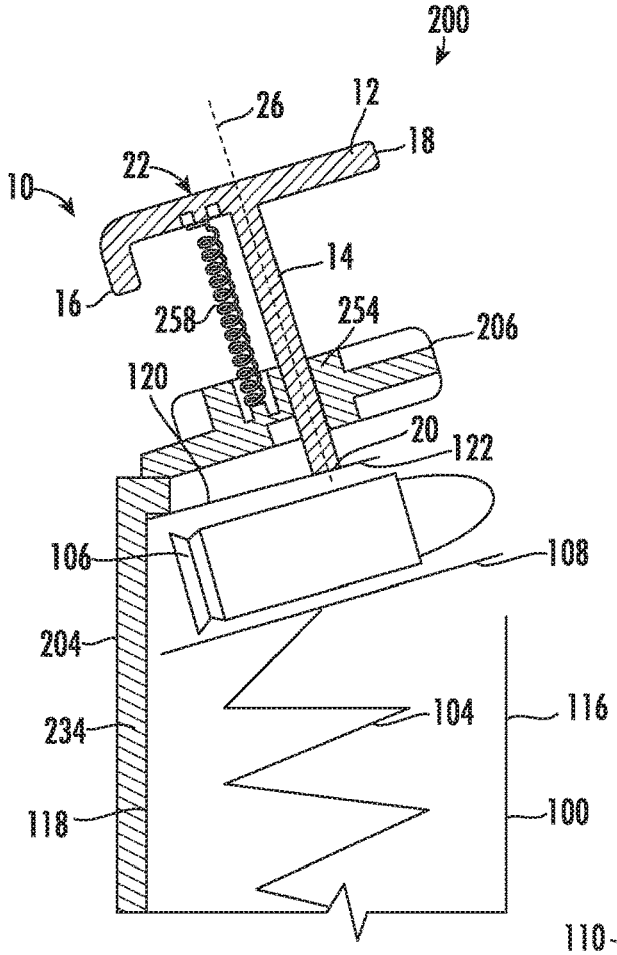
FIG. 11 illustrates a loader assembly having a loader in a first position prior to the compression of an internal spring of a firearm magazine, in accordance with embodiments of the present disclosure.
Figure 12:
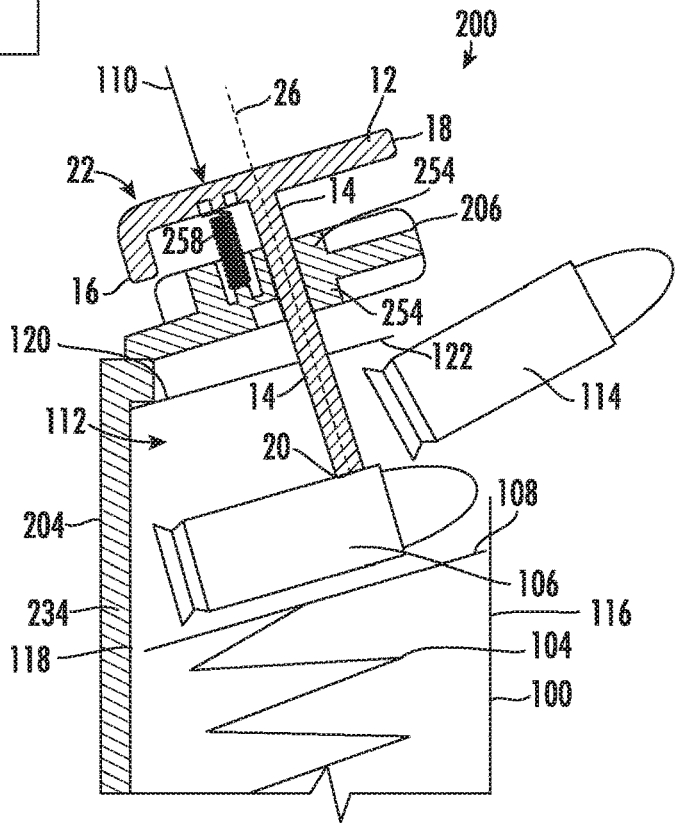
FIG. 12 illustrates a loader assembly having a loader in a second position being utilized to compress an internal spring of a firearm magazine, in accordance with embodiments of the present disclosure.

In many embodiments, as shown in FIGS. 10-12, the loader assembly 200 may further include a biasing element 258, such as a compressible spring that provides an outward force (in a direction generally parallel to the depression axis 26) when compressed. For example, the loader 10 may be movable along the depression axis 26 within the guide frame 206 from a first position (FIG. 11) in which the biasing element 258 is uncompressed to a second position (FIG. 12) in which the biasing element 258 is fully compressed.

FIGS. 11 and 12 illustrate a loader assembly 200 being utilized to compress an internal spring 104 of a firearm magazine 100. As shown, the firearm magazine 100 may have one of the external walls removed, in order to depict how the loader assembly 200 interacts with the internals of the firearm magazine 100. Specifically, FIG. 11 illustrates the loader 10 of the loader assembly 200 in a first position, in which no force is applied to the outer contact surface 22 of the press member 12 and the biasing element 258 is entirely uncompressed. FIG. 12 illustrates a force 110 being applied to the outer contact surface 22 of the press member 12 (which may be supplied by one of a user's finger or thumb), thereby driving the plunger member 14 onto the exterior surface of the first cartridge 106 and compressing the internal spring 104 of the firearm magazine 100. The plunger member 14 may also be driven onto the feed surface 108 of the firearm magazine 100 to compress the internal spring 104 if no cartridges have yet been loaded. In this way, the force 110 is transferred from the user's finger or thumb by the plunger member 14 to the internal spring 104 of the firearm magazine 100. As shown in FIG. 6, once the internal spring 104 is compressed by the loader 10, an opening 112 is defined within the firearm magazine 100, that allows a second cartridge 114 to be loaded into the firearm magazine 100 easily. The above described process may be repeated until the firearm magazine 100 is fully loaded (or at capacity) with cartridges.

As shown in FIGS. 11 and 12, and as is generally understood, the firearm magazine 100 may include a forward wall 116, a back wall 118, and feed lips 120. The feed lips 120 may extend from the back wall 118 to a forward end 122 that is between the forward wall 116 and the back wall 118 of the firearm magazine 100. As is understood, the feed lips 120 of the firearm magazine function to retain loaded cartridges and eject the loaded cartridges into the firearm at a desired angle. When loading a firearm magazine 100, the cartridges must be slid under the feed lips 120, which can often prove difficult.

In the loader 10 embodiments shown in FIGS. 6 and 7, since the loader 10 may be coupled to a user's digit (such as the user's finger or thumb), the depression axis 26 and plunger member 14 may be positioned by the user wherever is most advantageous for compressing the internal spring 104. For example, the depression axis 26 (and plunger member 14) may be adjusted forward or rearward as the spring pressure of the firearm magazine 100 dictates. If the spring pressure requires initial depression forward of the forward end 122 of the feed lips 120 (i.e. between the forward end 122 and the forward wall 116), then the plunger 14 may be positioned accordingly. Subsequently, due to the advantageous sizing of the plunger member 14 discussed above, the plunger 14 may be moved or pushed by the next cartridge 114 to a position that is behind the forward end 122 of the feed lips 120 (i.e. between the forward end 122 and the back wall 118), in order to allow for the cartridge 114 to engage the feed lips 120.

In the loader assembly 200 embodiments, as shown in FIGS. 11 and 12, the loader 10 may be coupled to a clamping assembly 202 such that the loader 10 is restricted to movement along the depression axis 26. In such embodiments, the depression axis 26 may be positioned far enough behind the forward end 122 of the feed lips 120, in order to allow depressing the magazine follower 108/last cartridge 106 and still allow the next cartridge 114 to engage below the forward end 122 of the feed lips 120 before the plunger member 14 is retracted. In this way, the plunger member 14 may be used to compress the internal spring 104 while providing enough space for the second cartridge 114 to engage the feed lips 120. For example, the depression axis 26 may be positioned between a back wall 118 of the firearm magazine 100 and a forward end 122 of the feed lips 120 of the firearm magazine 100, such that the plunger member 14 is capable of compressing the internal spring 104 while allowing space for the feed lips 120 to engage and retain the second cartridge 114.

Figure 13:
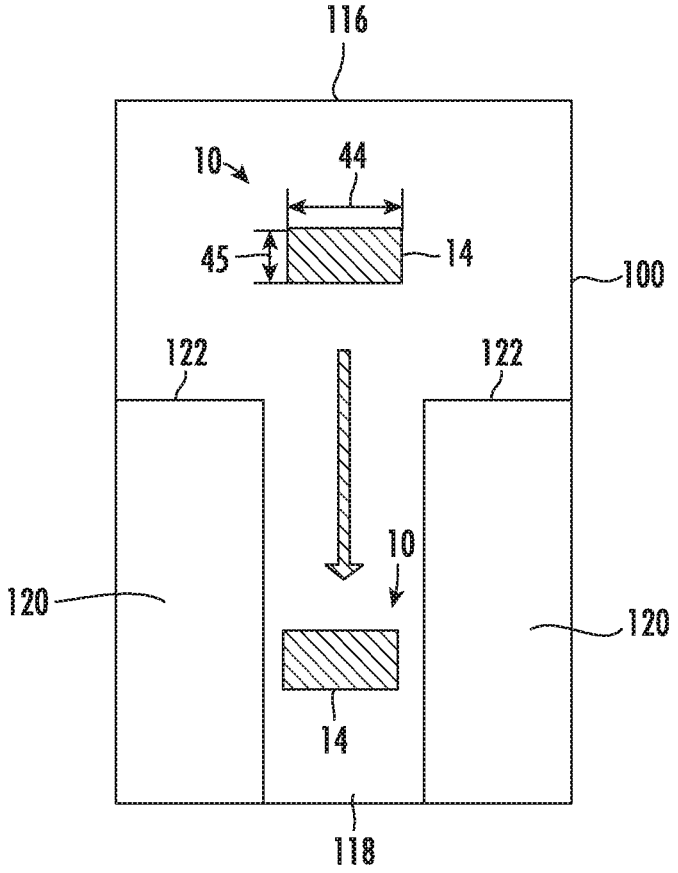
FIG. 13 illustrates a top view of a firearm magazine and a cross section of the plunger member of the loader positioned within the firearm magazine, in accordance with embodiments of the present disclosure.

FIG. 13 illustrates a top view of a firearm magazine 100 and a cross section of the plunger member 14 of the loader 10 from along the depression axis 26 and positioned within the firearm magazine 100. As shown in FIG. 13, the first width 42, the second width 44, and the thickness 45 of the plunger member may be sized to allow the plunger member 14 to move between the firearm magazine feed lips 120 and towards a back wall 118 of the firearm magazine. This advantageously provides additional room for sliding the cartridges 106, 114 under the feed lips 120 while using the plunger member 14 to compress the internal spring 104 of the firearm magazine.

The loader as in claim 2, wherein the first width is between about 0.374 inches and about 0.306 inches, and wherein the second width is between about 0.187 inches and about 0.153 inches.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A loader assembly that facilitates loading a cartridge into a firearm magazine, the loader assembly defining a longitudinal direction, a vertical direction, and a transverse direction, the loader assembly comprising:

loader movably coupled to a clamping assembly, the loader comprising a press member extending from a first end to a second end and a plunger member extending generally perpendicularly from the press member to a free end, the free end sized to engage the cartridge when loading the firearm magazine, the clamping assembly configured to clutch the firearm magazine during the loading of the cartridge into the firearm magazine, the clamping assembly comprising:

a grip plate extending from a first end to a second end in the vertical direction;

a guide frame coupled to the first end of the grip plate, the guide frame including at least one guide member;

a first side plate and a second side plate, the first side plate and the second side plate each including follower portions that slidably couple to the at least one guide member of the guide frame;

a first connection plate disposed between the first side plate and the grip plate and rotatably coupled to both the grip plate and the first side plate; and a second connection plate disposed between the second side plate and the grip plate and rotatably coupled to both the grip plate and the second side plate.

2. The loader assembly as in claim 1, wherein the grip plate includes a first side portion, a second side portion, and an end portion, the first side portion and the second side portion each extending from the end portion in the longitudinal direction and the end portion extending in the transverse direction.

3. The loader assembly as in claim 2, wherein the guide frame forms an angle with the end portion of the grip plate that is between about 97° and about 117°.

4. The loader assembly as in claim 1, wherein the guide frame includes a central portion that defines an opening, and wherein the plunger member of the loader extends through the opening of the central portion and is movable within the opening of the central portion.

5. The loader assembly as in claim 4, wherein a biasing element extends between the press member of the loader and the guide frame.

6. The loader assembly as in claim 5, wherein the plunger member extends along a depression axis, and wherein the loader is movable along the depression axis within the guide frame from a first position in which the biasing element is uncompressed to a second position in which the biasing element is fully compressed.

7. The loader assembly as in claim 1, wherein the first connection plate is connected to the grip plate via a first plurality of ball socket joints and connected to the first side plate via a second plurality of ball socket joints, and wherein the second connection plate is connected to the grip plate via a third plurality of ball socket joints and connected to the second side plate via a fourth plurality of ball socket joints.

8. The loader assembly as in claim 1, wherein the plunger member of the loader defines a first width at a coupled end and a second width at the free end, wherein the first width is larger than the second width, and the plunger member tapers from the first width to the second width.

9. The loader assembly as in claim 8, wherein the first width is between about 0.374 inches and about 0.306 inches, and wherein the second width is between about 0.187 inches and about 0.153 inches.

* * * * *